US010294716B2

(12) United States Patent
Ege et al.

(10) Patent No.: US 10,294,716 B2
(45) Date of Patent: May 21, 2019

(54) PRE-HUNG DOORS AND METHODS OF INSTALLATION THEREFOR

(71) Applicant: Masonite Corporation, Tampa, FL (US)

(72) Inventors: Patrick C. Ege, Westmont, IL (US); Chris W. Cicenas, Etna, OH (US); Don R. Lindsey, Clarendon Hills, IL (US); William W. Kling, Lombard, IL (US); Steven B. Swartzmiller, Batavia, IL (US); Ross C. Worden, Blacklick, OH (US); Sean W. Svendsen, Columbus, OH (US); Keith R. Kometer, Geneva, IL (US); Jan H. Ettrich, Geneva, IL (US); Joseph M. Lehman, New Albany, OH (US)

(73) Assignee: Masonite Corporation, Tampa, FL (US)

( * ) Notice: Subject to any disclaimer, the term of this patent is extended or adjusted under 35 U.S.C. 154(b) by 80 days.

(21) Appl. No.: 15/459,945

(22) Filed: Mar. 15, 2017

(65) Prior Publication Data

US 2017/0268240 A1 Sep. 21, 2017

Related U.S. Application Data

(60) Provisional application No. 62/308,518, filed on Mar. 15, 2016.

(51) Int. Cl.

| | |
|---|---|
| ***E06B 7/28*** | (2006.01) |
| ***E04F 21/00*** | (2006.01) |
| ***E06B 1/52*** | (2006.01) |

(52) U.S. Cl.

CPC ..... *E06B 7/28* (2013.01); *E04F 21/0023* (2013.01); *E06B 1/52* (2013.01)

(58) Field of Classification Search

CPC ..... E04F 21/0023; E05B 17/0012
USPC ..... 49/380
See application file for complete search history.

(56) References Cited

U.S. PATENT DOCUMENTS

| | | | | |
|---|---|---|---|---|
| 2,489,029 | A | 11/1949 | Guerrant | |
| 2,742,146 | A | 4/1956 | Lester, Jr. | |
| 2,887,219 | A | 5/1959 | Lester, Jr. | |
| 3,205,982 | A | 9/1965 | Chimienti | |
| 3,301,820 | A * | 1/1967 | Haendiges | E06B 1/52 206/325 |

(Continued)

OTHER PUBLICATIONS

ISR for PCT/US2017/022557, dated Jun. 7, 2017.

*Primary Examiner* — Marcus Menezes
(74) *Attorney, Agent, or Firm* — Berenato & White, LLC

(57) ABSTRACT

The present invention provides a pre-hung door assembly containing a door slab hung inside a door frame. The margins (space between the perimeter of the door and the frame) between the door slab and the door frame are maintained using at least one door jamb margin holder, at least one door lock margin holder, at least one bottom margin holder, or combinations of these holders. The margin holders allow the margins to be maintained and prevent unwanted opening of the door during the shipping and transportation of the door assembly. The jambs of door frame may include predrilled holes for securing the door assembly to the door opening. Details for the door jamb margin holder, the door lock margin holder, and the bottom margin; and methods for installation of the door assembly are also provided.

16 Claims, 5 Drawing Sheets

(56) References Cited

U.S. PATENT DOCUMENTS 3,584,416 A 6/1971 Baumgartel
3,593,458 A * 7/1971 Wahlfeld ..... E06B 7/00 206/325
4,483,101 A * 11/1984 Berzina ..... E06B 7/00 206/325
5,562,315 A * 10/1996 Sales ..... E05C 1/04 292/150
5,655,332 A 8/1997 Papadopoulos
6,029,410 A 2/2000 Westberg, II et al.
6,170,198 B1 * 1/2001 Staples ..... E06B 7/00 49/380
6,357,200 B1 3/2002 Vanderpan
6,481,811 B1 11/2002 Marsh
6,533,374 B2 3/2003 Hightower
6,725,604 B1 4/2004 Vanderpan
6,729,664 B1 5/2004 Marsh et al.
6,971,514 B2 12/2005 VanderWerf et al.
7,213,371 B1 * 5/2007 Vanderpan ..... E05B 17/0012 206/325
7,581,352 B2 * 9/2009 Klingbyle ..... E06B 7/28 206/325
7,780,206 B2 8/2010 Marsh et al.
7,891,136 B1 2/2011 Heroux
8,245,448 B2 * 8/2012 Crane ..... E05B 17/0012 206/325
9,382,751 B2 * 7/2016 Hemping ..... E05B 1/003
9,482,016 B2 * 11/2016 Kelley ..... E04F 21/0007
2003/0005641 A1 1/2003 Eakes et al.
2004/0060241 A1 * 4/2004 Staples ..... E06B 7/28 49/380
2004/0201228 A1 * 10/2004 L'Heureux ..... E05B 17/0012 292/301
2005/0102906 A1 * 5/2005 Massey ..... E05B 17/0012 49/380
2006/0236611 A1 * 10/2006 Klingbyle ..... E06B 7/28 49/380
2010/0166524 A1 * 7/2010 Crane ..... E05B 17/0012 411/103
2016/0319557 A1 * 11/2016 Gordon ..... E04F 21/0015

* cited by examiner

PRE-HUNG DOORS AND METHODS OF INSTALLATION THEREFOR

CROSS-REFERENCE TO RELATED APPLICATIONS AND CLAIM TO PRIORITY

This application claims priority to U.S. Provisional Patent Applications No. 62/308,518, filed Mar. 15, 2016, the disclosure of which is incorporated herein by reference.

FIELD OF THE INVENTION

The present invention relates to pre-hung doors and methods of installation therefor. In particular, the pre-hung door contains margin holders for maintaining predetermined margins between the door frame and thedoor slab, so that installation of the door is simplified, does not require adjustment of the margins and may be installed by a single installer.

BACKGROUND

Pre-hung door assemblies are commonly installed in rough openings of newly constructed and/or renovated structures, such as houses. Such openings define passageways between adjacent rooms or passageways from the inside of a room to the outside thereof. A pre-hung door assembly typically includes a substantially rectangular door frame having a door slab hingedly attached thereto. The door assembly is configured for attachment within a rough opening formed in a wall, for example in a house, a building, or the like. These pre-hung door assemblies are advantageous in that the frame and the door are pre-aligned, requiring only the frame to be attached and aligned within the rough opening and thus eliminate the steps of aligning and the orienting the door to the frame.

However, when a pre-hung door assembly is being installed, care must be taken to adjust and assure that margin(s) between the frame and the door slab remain within predetermined tolerances in order to provide the desired seal around the perimeter of the door sklab. Typical installation requires opening of the door or having two persons to adjust the margins (by shimming) before permanently fixing the frame within the rough opening. In a typical two-person operation, one person, on the outside of the door, places the door assembly in place, and another person, on the inside of the door, checks the margins and shims the door slab to adjust for the proper margins. In a typical one-person operation, the person installs the door assembly from the outside, and then must go to the other side of the door assembly to adjust the margins.

Therefore, there remains a need for a pre-hung door assembly with a simplified installation process which allows for permanent fixing of the frame and its attached door to the rough wall opening without requiring an adjustment of the door margins during installation while allowing the installation process to take place from only one side of the door.

SUMMARY OF THE INVENTION

An aspect of the present invention provides a pre-hung door assembly comprising a door slab hung inside a door frame. The margins (space between the perimeter of the door slab and the frame) between the door slab and the door frame are maintained using at least one door jamb margin holder, at least one door lock margin holder, at least one bottom margin holder, or combinations of these holders. The margin holders allow the margins to be maintained and prevent unwanted opening of the door assembly during the shipping and transportation of the door assembly. The jambs of the door frame may include predrilled holes for securing the door assembly with the door rough opening.

Another aspect of the present invention provides a door jamb margin holder, a door lock margin holder, and a bottom margin holder. Each of the margin holders is configured to maintain the margins between the door slab and the door frame between door hanging at the place of assembly and the place of installation. The margin holders may also be configured to retain the door in its closed position on the door frame and prevent unwanted opening of the door assembly during shipping and transportation. The margin holders are designed to be held in place without requiring a fastener, such as a nail or screw.

A further aspect of the present invention provides methods for installing a pre-hung door assembly without requiring adjustment of the margins during the installation process. The methods include the steps of securing the door assembly to the wall opening before removal of the margins holders.

Other aspects of the invention, including apparatus, devices, kits, processes, and the like which constitute part of the invention, will become more apparent upon reading the following detailed description of the exemplary embodiments.

BRIEF DESCRIPTION OF THE DRAWINGS

The foregoing background and summary, as well as the following detailed description of the drawings, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION

Figure 1:
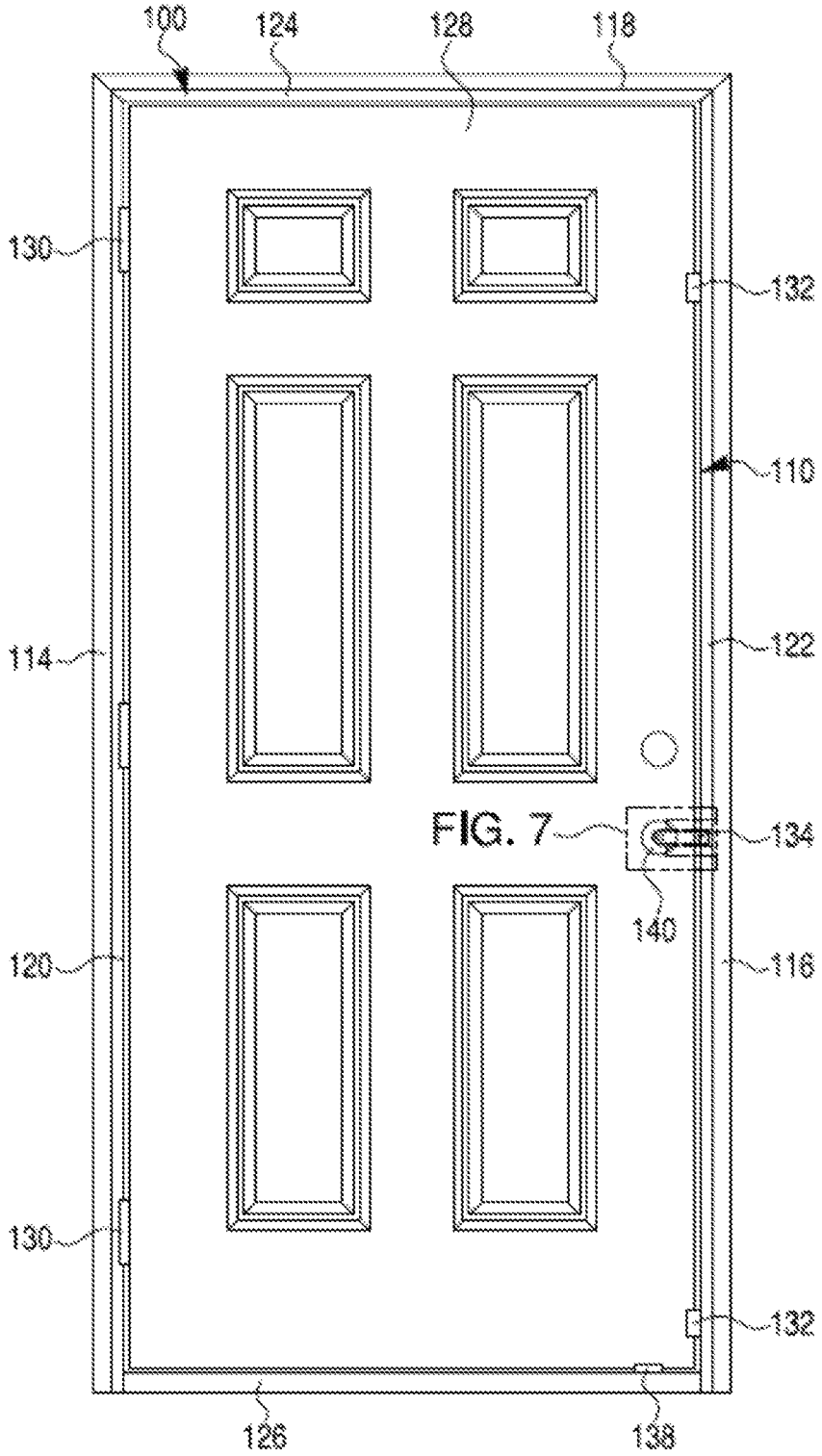
FIG. 1 is a front elevational view showing an outside view of a pre-hung door assembly according to an embodiment of the invention.

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods. Like reference characters refer to like parts throughout the drawings.

Referring to FIG. 1, the present invention provides a pre-hung door assembly 100 and methods for mounting the pre-hung door assembly 100 in a wall opening of a building. Installation of the door assembly 100 requires minimal labor and time, by not requiring margin adjustment before and/or during its installation. The wall opening is typically framed by building studs 114, 116 connected by an opening header 118 extending between the studs 114, 116 at the top. The wall opening, framed by the studs 114, 116 and the header 118, is prepared for a selected door frame size, so that a door frame 110 of selected size can fit and be retained therein.

The pre-hung door assembly 100 typically comprises a door frame 110 and a door slab 128 hung therein. The door frame 110 is typically formed by parallel, spaced apart, vertical jambs 120 (hinge side jamb), 122 (lock side jamb) and a horizontal header 124 connecting the top ends of the jambs 120, 122. The jambs 120, 122 and horizontal header 124 are typically made of wood, such as pine or fir, with pine being preferred, although hardwoods, plastics or composite materials may also be used. Optionally, the door frame 110 may also include a sill 126 installed at the foot of the frame 110, connecting the lower ends of the jambs 120, 122.

Figure 2:
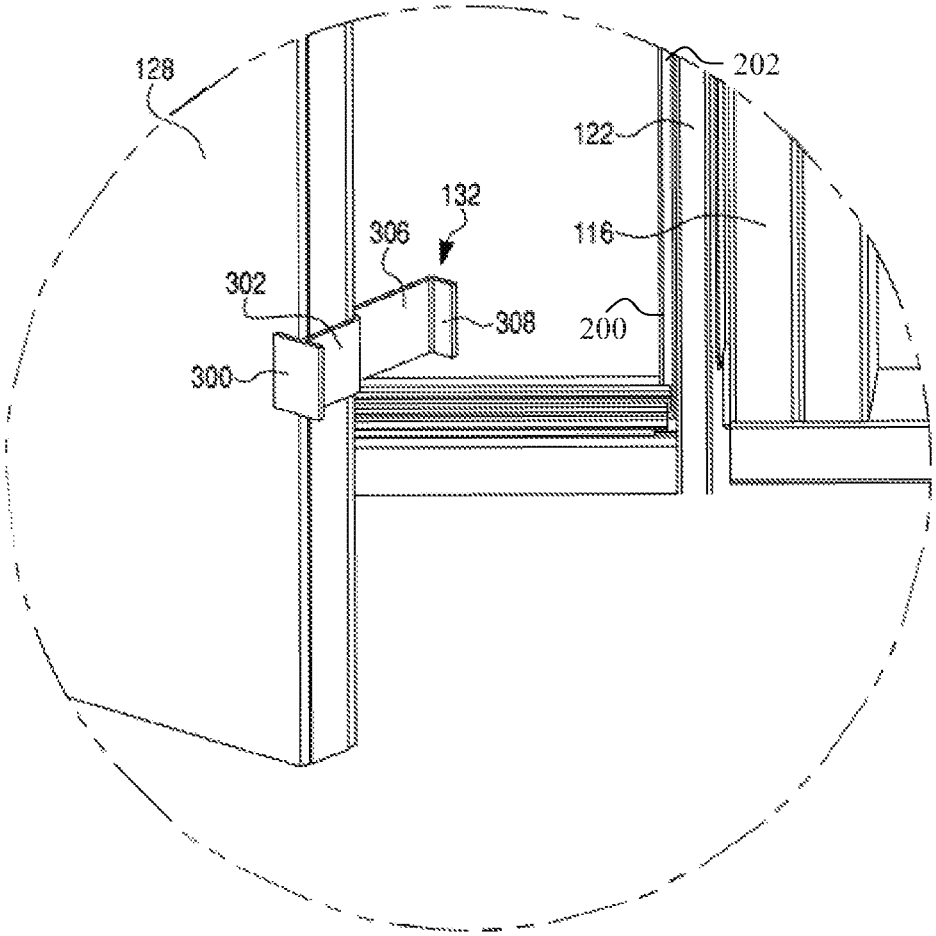
FIG. 2 is a fragmentary perspective view showing the door jamb margin holder clipped to the door slab.

A door slab 128 is provided within the door frame 110, as best shown in FIG. 1, to form the pre-hung door assembly 100. The doors slab 128 may be hollow core or solid core and may be constructed, e.g., as described in U.S. Patent Application Publication No. 2014/0261991, which is incorporated herein by reference. The door slab 128 may be hingedly attached to the hinge side jamb 120 by two or more hinges 130. Although FIG. 1 shows three hinges 130, two, four, five, or more hinges 130 may be used to attach the door slab 128 to the hinge side jamb 120, depending on the size of the door slab 128. The hinges 130 may be typical door hinges used to mount doors to allow the door slab 128 to swing between a closed position and an opened position. For a door slab 128 to properly close within the door frame 100, the margins or spaces between the door slab 128 and door frame 100 are maintained using at least one door jamb margin holder 132, or at least one door lock margin holder 134, or at least one bottom margin holder 138, or combinations of these holders. The margin holders 132, 134, 138 may be used together or separately to secure the door slab 128 to the door frame 110 to prevent unwanted opening during transportation and installation of the pre-hung door assembly 100, and to properly maintain and align the door slab 128 within the door frame 110. The margin holders 132, 134, 138 also hold the door slab 128 in proper alignment relative to the door stop 200 (as best shown in FIG. 2) on the frame 110 so that, when the door slab 128 is in its closed position, a proper seal is effected, preferably between the door slab 128 and a weather strip 202 (as best shown in FIG. 2) commonly attached to part the door frame 110. Preferably, all three margin holders 132, 134, and 138 are used. Importantly, the margin holders 132, 134, 138 allow for installation of the pre-hung door assembly 100 with minimum labor and without first requiring adjustment of the door margins at the installation site. Usually, two persons are need to install a typical pre-hung door assembly, one person for adjusting the door margins on the inside of the door and another person for securing the jambs to the studs on the outside of the door frame. Because the present pre-hung door assembly 100 eliminates the need for adjusting the door margins, only one person is needed for installation of the door assembly, substantially reducing labor requirements.

Figure 3:
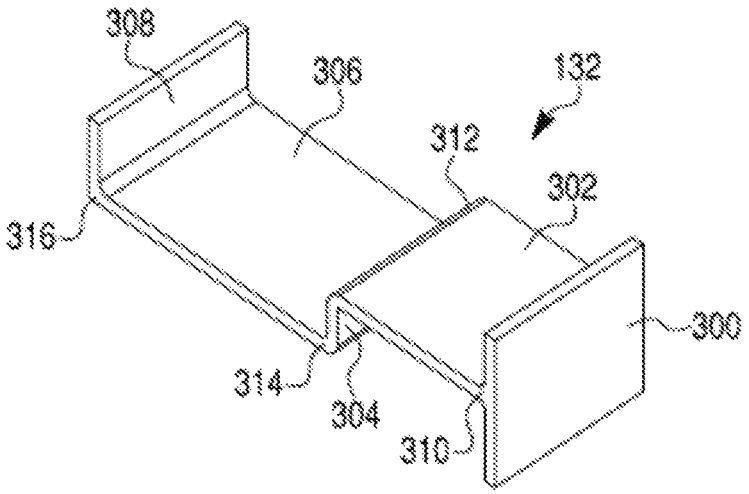
FIG. 3 is a perspective view of the door jamb margin holder.

The door jamb margin holder 132 maintains the desired margin between the door slab 128 and the lock side jamb 122. In an exemplary embodiment, the door jamb margin holder 132, as best shown in FIGS. 2-3, is configured to clip to the profile of the door slab 128 and to interface with the door slab 128 and the profile of the lock side jamb 122. Preferably, the door jamb margin holder 132, as best shown in FIG. 3, has a generally S-shaped profile with five flat, preferably rectangular, interconnected portions: a substantially parallel first terminal portion 300, second terminal portion 308, and connector portion 304 between the first and second terminal portions 300, 308; and substantially parallel first profile portion 302 and second profile portion 306. The profile portions 302, 306 are substantially perpendicular to the terminal portions 300, 308 and the connector portion 304, with the first terminal portion 300 being perpendicular to a first end 310 the first profile portion 302. Although FIG. 3 shows the first terminal portion 300 forming a T with a first end 310 of the first profile portion 302, that needs not be the case, as long as the terminal portion 300 contains a portion opposing the connector portion 304, so that the door slab 128 can be clipped there between (as best shown in FIG. 2 and discussed in further detail below). For example, instead of a T, the first terminal portion 300 may form an L with a first end 310 of the first profile portion 302. A second end 312 (opposing the first end 310) of the first profile portion 302 and a first end 314 of the second profile portion 306 are connected to opposing ends of the connector portion 304, with the first profile portion 302 and the second profile portion 306 extending in opposing directions. A second end 316 (opposing the first end 314) of the second profile portion 306 connects to one end of the second terminal portion 308. The portions 300, 302, 304, 306, 308 of the margin holder 132 are preferably of uniform thickness. The door jamb margin holder preferably is a molded polymer piece, so that the portions 300, 302, 304, 306, and 308 are integral.

In use, the door jamb margin holder 132 is clipped onto the profile of the door slab 128 (as best illustrated in FIG. 2) and the profile of the lock side jamb 122. As best illustrated in FIG. 2, the first terminal portion 300 and the connector portion 304 clip to the door slab 128 and lay adjacent to and coplanar with inner and outer surfaces of the door slab 128. When the door slab 128 is in a closed position, as shown in FIG. 1, the first and second terminal portions 300, 308 clip to the lock side jam 122. That way, the door slab 128 is held in a closed position by the door jamb margin holder 132 with the first profile portion 302 located between the door slab 128 and the lock side door jamb 122 to maintain the proper spacing therebetween. Preferably, at least two door jamb margin holders 132 are used, with one located between the vertical middle of the door 128 and the bottom of the door 128 and one located between the vertical middle of the door 128 and the top of the door 128.

Figure 4:
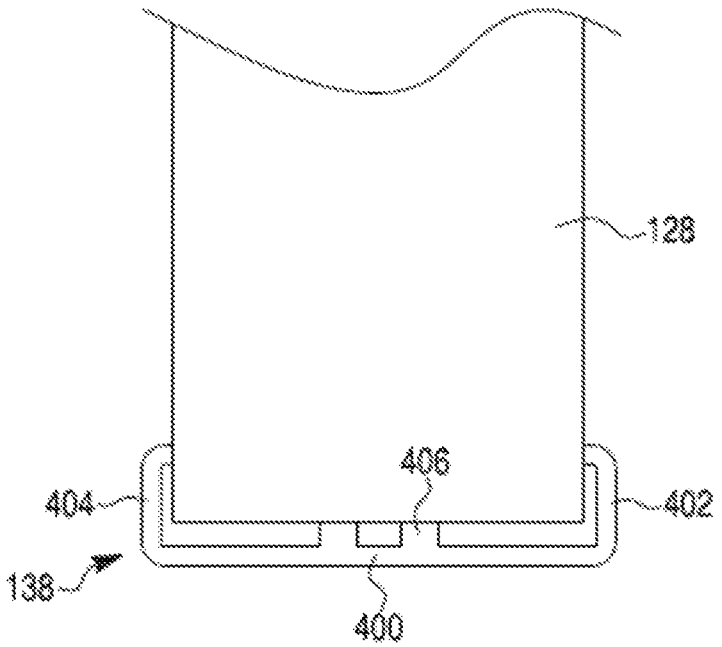
FIG. 4 is a fragmentary cross-sectional view of the bottom margin holder clipped to the door.
Figure 8:
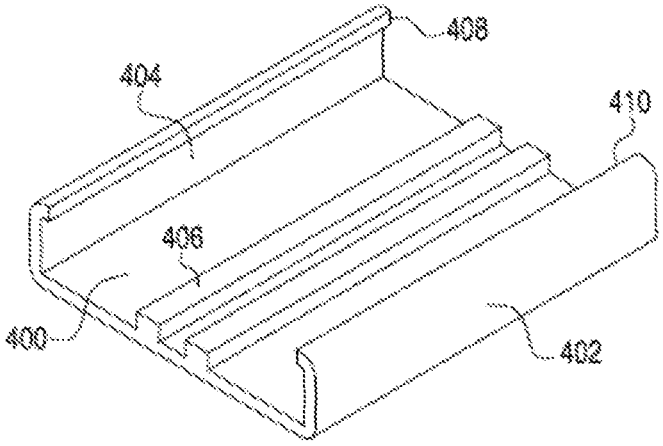
FIG. 8 is a perspective view of the bottom margin holder.

The bottom margin holder 138 maintains the desired margin between the bottom of the door slab 128 and the sill 126, if one is present. In an exemplary embodiment, the bottom margin holder 138, as best shown in FIGS. 4 and 8, has a C-shape cross-section with a middle portion 400 whose ends are approximately perpendicular to a first end portion 402 and a second end portion 404, respectively. The middle portion 400, and first and second end portions 402, 404 are substantially flat, and preferably rectangular. In certain embodiments, the first and second end portions 402, 404 may contain free ends 408, 410 that curve inward toward the middle portion 400 (as best illustrated in FIG. 8) to provide increased friction against the inner and outer surfaces of the door slab 128. One or more protrusions 406 may be present on the middle portion 400 extending the length of the bottom margin holder 138, preferably parallel to the first and second end portions 402, 404. The protrusion 406, and first and second ends 402, 404 extend in the same direction from the middle portion 400 of the bottom margin holder 138. The protrusion(s) 406 maintain vertical spacing of the door slab 128 relative to the middle portion 400. The margin holder 138 preferably is also made of a polymer material, and preferably is formed by an extrusion process. The bottom margin holder 138 preferably is a molded polymer piece so that the portions 400, 402, 404, 406, 408, and 410 are integral.

In use, the bottom margin holder 138 frictionally clips onto the profile of the door slab 128 at the bottom of the door slab 128, as best shown in FIG. 4, due to flexing of the portions 402, 404. When the door slab 128 is in its closed position, the bottom margin holder 138 is located between the bottom of the door slab 128 and the sill 126 to maintain the proper margin between the sill 126 and the door slab 128. One or more bottom margin holders 138 may be used on a pre-hung door assembly 100, depending on the size of the door slab 128. Preferably, when one bottom margin holder 138 is used, it is located closer to the to the lock side jamb 122 than the hinge side jamb 120. Because the bottom margin holder 138 carries much of the weight of the door slab 128, that preferred position better allows it to prevent the door slab 128 from sagging within the frame 110, thereby keeping the door slab 128 in proper alignment.

Figure 7:
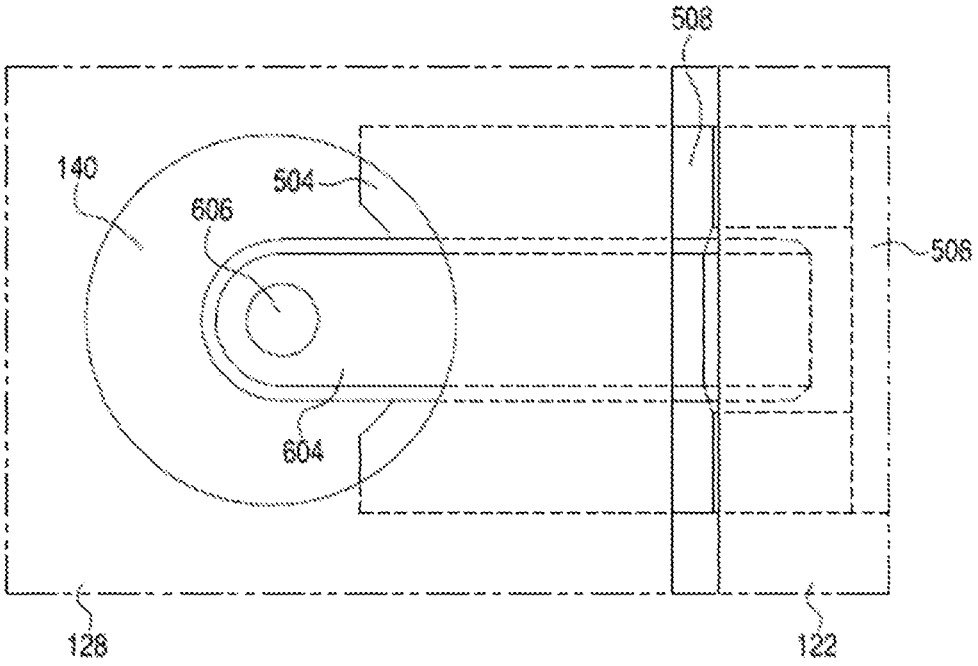
FIG. 7 is a cross-sectional view showing an enlarged view of the dashed rectangle of FIG. 1.

In certain embodiments, the door slab 128 may contain one or more knob holes 140, as shown in FIGS. 1 and 7, for installation of one or more locks, knobs, and/or latches. In those embodiments, the pre-hung door assembly 100 may include one or more door lock margin holders 134 to hold the door slab 128 in place and to maintain the desired margins between the door slab 128 and the lock side jamb 122. In an exemplary embodiment, the door lock margin holder 134 includes two parts, a latch base 500 and a latch pin 600.

Figure 5:
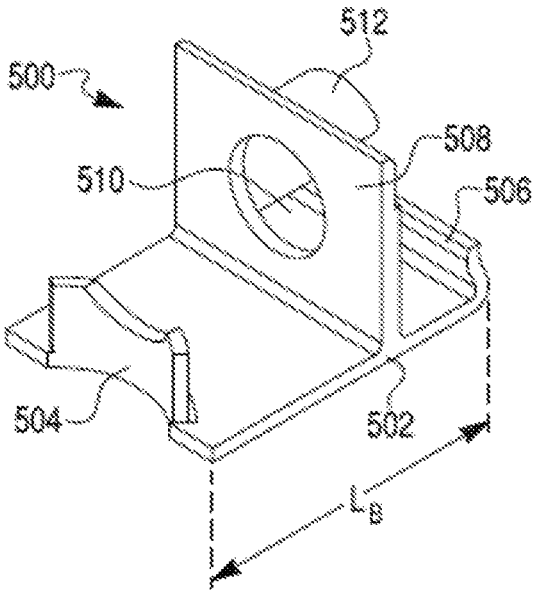
FIG. 5 is a perspective view of the latch base of the door lock margin holder.

The latch base 500, as best shown in FIG. 5, contains a substantially flat base portion 502, a knob clip 504, a jamb clip 506, and a middle wall 508, extending approximately perpendicularly from the base portion 500. The knob clip 504 is located at a first end of the base portion 502 and has an arcuate cross-section to conform to the circumference of the knob hole 140 in the door slab 128 (as described in further detail below). The arcuately contoured jamb clip 506 is located at a second end of the base portion 500 which opposes the first end, and is configured to allow the latch base 500 to be clipped to the outside of the lock side jamb 122 (as described in further detail below). The middle wall 508 is located between the knob clip 504 and the jamb clip 506, and is configured to be located between the door slab 128 and the lock side jamb 122. The middle wall 508 contains a hole 510 at approximately its center. The hole 510 is configured to align with a strike plate hole in the lock side jamb 122, and contains a semicircular guide 512 extending toward the jamb clip 506 from the circumference of the hole 510 at approximately perpendicular from the plane of the middle wall 508. The guide 512 is configured to insert into a strike plate hole (not shown) in the lock side jamb 122 (as described in further detail below). The latch base 500 preferably is a molded polymer piece so that the base portion 502, knob clip 504, jamb clip 506, and middle wall 508 are integral.

Figure 6:
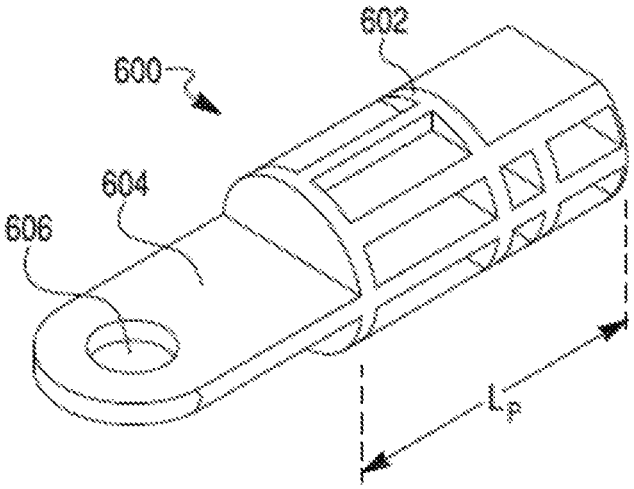
FIG. 6 is a perspective view of the latch pin of the door lock margin holder.

The latch pin 600 cooperates with the latch base 500 to hold it in place. The latch pin 600, as best shown in FIG. 6, contains a generally cylindrical plug 602 that is connected to a flat tab 604. The end of the flat tab 604 may contain a hole 606 for facilitating removal of the door lock margin holder 134, after the door is installed. The cylindrical plug 602 has a length $L_P$ that is slightly longer than the length $L_B$ of the guide 512 on the latch base 500. The latch pin 600 is preferably a molded polymer piece so that its components are integral.

In use, when the door slab 128 is in its closed position in the pre-hung door assembly 100, as best illustrated in FIG. 7, the latch base 500 is installed such that 1) the knob clip 504 lays adjacent to the inner circumference of the knob hole 140; 2) the middle wall 508 is located between the door slab 128 and the lock side jamb 122, such that the guide 512 extends into the strike plate hole in the jamb 122; and 3) the jamb clip 506 clips to the outside of the lock side jamb 122. In that position, the hole 510 of the latch base 500 aligns with a latch hole (not shown) in the door slab 128 and the strike plate hole (not shown) in the lock side jamb 122. The cylindrical plug 602 of the latch pin 600 is inserted through the latch hole in the door slab 128 through the hole 510 of the latch base and into the strike plate hole in the lock side jamb 122, such that the flat tab 604 is visible in the knob hole 140 of the door slab 128. The cylindrical plug 602 fits snugly through the hole 510 in the middle wall 508 to hold the lock margin holder 134 in place. When properly positioned, the lock margin holder 134 maintains the desired margins between the door slab 128 and the lock side jamb 122, and provides the proper alignment between the latch hole on the door slab 128 and the strike plate hole on the lock side jamb 122.

The door jamb margin holder 132, door lock margin holder 134, and bottom margin holder 138 may be manufactured by any suitable technique, including, but not limited to, being extruded, formed, molded, pressed, and/or milled using a variety of materials. More specifically, extrusion, co-extrusion and injection molding techniques may be implemented to form the margin holders 132, 134, or 138. Alternatively, the margin holder 132, 134, or 138 may be molded into the proper shape by injection molding techniques, pressed into the proper shape using thermoplastic, fiber, or composite construction, or produced utilizing a vacuum forming or extrusion methods. The margin holders 132, 134, or 138 may be constructed by extrusion or co-extrusion of both cellular and/or rigid PVC. However, it will be appreciated that manufacturing materials such as, polystyrene, polyethylene, poly(ethylene terephthalate) (PET) thermoplastic, or any suitable combination of thermoplastic, fiber, composite, and/or metal may be used. In an embodiment, the door jamb margin holder 132, door lock margin holder 134, and bottom margin holder 138 are made of a polymeric material, and preferably are manufactured by an extrusion process or injection molding process. The polymer material may comprise, but is not limited to, polyethylene, polypropylene, polyvinyl chloride (PVC), polystyrene, polyethylene terephthalate (PET), acrylonitrile butadiene styrene (ABS), or combinations thereof.

In certain embodiments, the hinge side jamb 120 and the lock side jamb 122 contain predrilled holes for installation of the pre-hung door assembly 100 into the rough wall opening. The predrilled holes are spaced along the jambs 120, 122, preferably with each of the jambs 120, 122 containing at least three predrilled holes, one above the top hinge, one at approximately the middle of the jamb, and one below the bottom hinge. Preferably, the predrilled holes are positioned toward the outside of the door frame 110 (the side away from which the door opens), rather than the center or inside of the door frame 110.

During installation, once the studs 114, 116 are plumbed, the pre-hung door assembly 100 is positioned inside the rough wall opening. After the door assembly 100 is placed into the wall opening, fasteners, such as screws, are used to secure the jambs 120, 122 to their respective studs 114, 116, through the predrilled holes if they are present. After the door assembly 100 is secured in the wall opening, the margin holders 132, 134, 138 may be removed. The door lock margin holders 134 may be remove by pulling on the flat tab 604 away from the lock side jamb 122 and opening the door slab 128. The door jamb margin holder 132 may be removed by breaking the second terminal portion 308 or sliding it aside while opening the door slab 128. Preferably, the door jamb margin holder 132 is sufficiently flexible, so that the second terminal portion 308 may simply be bent aside to open the door slab 128. The bottom margin holder 138 merely falls out or may easily be removed, when the door slab 128 is opened. Once the door slab 128 is opened, the inside of the door assembly 110 may be accessed for further adjustment and installation steps. The margins of the door assembly 100 need not be adjusted during the installation process.

The pre-hung door assembly and methods of the present invention allows for complete installation of the door assembly within the door opening with only one person on one side, preferably the outside, of the door. Because the margins of the door are set and maintained by the one or more margin holders, no adjustment of the margins is necessary during the installation process. That way, a second person is not needed on the inside of the door to check the margins and shim the door. The present invention simplifies the installation of pre-hung door assemblies and provides great labor saving during the installation process.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A pre-hung door assembly, comprising:

a) a frame containing parallel, spaced apart, vertical hinge side jamb and lock side jamb, a horizontal header connecting top ends of the jambs, and a sill connecting bottom ends of the jambs;

b) a door slab hingedly mounted to the hinge side jamb in a closed position, the door slab contains opposing inner and outer surfaces; and c) at least one door jamb margin holder comprising i. a rectangular, flat first terminal portion, ii. a rectangular, flat first profile portion having a first end and a second end, the first end of the first profile portion is attached to the first terminal portion and extends perpendicularly therefrom, iii. a rectangular, flat connector portion having a first end and a second end, the first end of the flat connector portion extends perpendicularly from the second end of the first profile portion, iv. a rectangular, flat second profile portion having a first end and a second end, the first end of the second profile portion extends perpendicularly from the second end of the connector portion, and v. a rectangular, flat second terminal portion having a first end and a second end, the first end of the second terminal portion extends perpendicularly from the second end of the second profile portion, wherein the first terminal portion and the connector portion clip to the door slab and lay adjacent to and coplanar with the inner and outer surfaces, respectively, of the door slab and the first and second terminal portions clip to the lock side jam.

2. The pre-hung door assembly of claim 1, further comprising a door lock margin holder.

3. The pre-hung door assembly of claim 2, wherein the door lock margin holder is configured to mount to the lock side jamb and a knob hole on the door slab.

4. The pre-hung door assembly of claim 3, wherein the door lock margin holder comprises:

i. a latch base containing a base portion, a knob clip, a jamb clip, and a middle wall extending approximately perpendicularly from the base portion, wherein the knob clip and the jamb clip are at opposing ends of the base portion, and the middle wall is between the knob clip and the jamb clip and contains a hole; and ii. a latch pin having a cylindrical plug configured to fit through the hole of the latch base.

5. The pre-hung door assembly of claim 4, wherein a semicircular guide extends from the hole of the latch base toward the jamb.

6. The pre-hung door assembly of claim 4, wherein the knob clip has an arcuate cross-section.

7. The pre-hung door assembly of claim 4, wherein the latch pin further comprises a flat tab connected to the cylindrical plug, the flat tab containing a hole therein.

8. The pre-hung door assembly of claim 1, further comprising a bottom margin holder.

9. The pre-hung door assembly of claim 8, wherein the bottom margin holder is configured to clip to a bottom of the door slab.

10. The pre-hung door assembly of claim 9, wherein the bottom margin holder comprises:

i. a flat, rectangular middle portion having a first end and a second end;

ii. a flat, rectangular first end portion perpendicular to the first end of the middle portion; and iii. a flat, rectangular second end portion perpendicular to the second end of the middle portion.

11. The pre-hung door assembly of claim 10, wherein the middle portion, the first end portion, and the second end portion are integral.

12. The pre-hung door assembly of claim 10, wherein each of the first and second end portions has a free end that curves toward the middle portion.

13. The pre-hung door assembly of claim 10, wherein the middle portion has at least one raised protrusion extending parallel to the first and second end portions.

14. The pre-hung door assembly of claim 1, wherein the jambs contain predrilled holes for securing the jambs to studs of a wall opening.

15. A method for installing a pre-hung door assembly, comprising the steps of a) providing the pre-hung door assembly of claim 1;

b) placing the pre-hung door assembly into a wall opening;

c) securing the jambs to studs of the wall opening; and d) removing the at least one door jamb margin holder.

16. The pre-hung door assembly of claim 1, wherein the first terminal portion, the first profile portion, the connector portion, the second profile portion, and the second terminal portion are integral.

* * * * *